United States Patent [19]

Bassols Rheinfelder et al.

[11] Patent Number: 4,721,068

[45] Date of Patent: Jan. 26, 1988

[54] GAS-FIRED BOILER PLANT

[75] Inventors: Juan Bassols Rheinfelder, Hauset; Norbert Bednarek, Kelmis, both of Belgium; Jacob J. Marijnen, Nieuwenhagen, Netherlands

[73] Assignee: Rendamax AG, Zug, Switzerland

[21] Appl. No.: 936,884

[22] Filed: Dec. 2, 1986

[30] Foreign Application Priority Data

Dec. 10, 1985 [EP] European Pat. Off. ..... 85115685.1

[51] Int. Cl.[4] ..... F22B 23/06; F22B 37/10

[52] U.S. Cl. ..... 122/367 C; 122/235 C; 165/181; 165/182

[58] Field of Search ..... 122/235 C, 367 C, DIG. 13, 122/18; 165/179, 181, 182; 126/350 R

[56] References Cited

U.S. PATENT DOCUMENTS

| | | | |
|---|---|---|---|
| 2,578,136 | 12/1951 | Huet | 122/367 C |
| 3,800,748 | 4/1974 | Schindler et al. | 122/367 C |
| 4,501,232 | 2/1985 | Gordbegli et al. | 122/367 C X |

FOREIGN PATENT DOCUMENTS

| | | |
|---|---|---|
| 2245357 | 9/1972 | Fed. Rep. of Germany . |
| 667479 | 1/1929 | France . |
| 2470947 | 12/1979 | France . |

OTHER PUBLICATIONS

Klimaat Beheersing, vol. 13, No. 2, Feb. 1984, pp. 94–97, Zeist, Netherland; A. Van Den Dool "Saarloos bv, Rendamax HR-ketel voor centrale verwarming met extreem hoog gebruiksrendement".

*Primary Examiner*—Edward G. Favors

*Attorney, Agent, or Firm*—Claude A. S. Hamrick

[57] ABSTRACT

A gas-fired boiler plant comprises a burner bed (10) extending over a flat surface and heat exchanger pipes (61, 62) arranged above the burner bed (10), parallel to the said surface. The heat exchanger tubes (61, 62) comprise pipes (63, 64) equipped with a plurality of flat ribs (65, 65*a* . . . , 66, 66*a* . . . ) which extend substantially radially from the said pipes and which are provided in spaced arrangement over the length of the said heat exchanger pipes (61, 62). The ribs are provided with bent-off portions (70, 71, 72, 73, 74, 75). The hot flue gases (82) rising from the burner bed (10) flow through the gaps (84, 84*a*) formed between the said ribs (65, 65*a* . . . , 66, 66*a* . . . ) and pipes (63, 65). In order to improve both the convective heat transmission and the utilization of the radiant heat, the bent-over edges (70, 71, 74, 75) are inclined, at least partly, relative to the surface of said burner bed (10), the arrangement being selected in a manner to ensure that bent-over portions (70, 75) point towards the burner bed and the rising flue gases (82) are guided around the pipes (63, 64) along a roughly semicircular path (85).

6 Claims, 5 Drawing Figures

GAS-FIRED BOILER PLANT

The present invention relates to a gas-fired boiler plant comprising a burner bed extending over a flat surface and heat exchanger pipes arranged above the burner bed, parallel to the said surface, the heat exchanger tubes comprising pipes equipped with a plurality of flat ribs which extend substantially radially from the said pipes, which are provided in spaced arrangement over the length of the said heat exchanger pipes, which exhibit roughly the shape of annular rings and which are provided with bent-off portions formed by folding over marginal areas exhibiting roughly the shape of circular discs, and the flue gas rising from the burner bed flowing through the gaps formed between the said ribs and pipes.

A boiler plant of this type has been known already from DE-C-22 45 357.

It must be ensured with gas-fired boiler plants having a flat burner bed that both the convective heat transmission and the utilization of the radiant heat should be optimized. In this connection, heat transmission means the transmission of the heat from the hot air rising from the burner bed to the surfaces of a heat exchanger, while the radiant heat is utilized by having the surfaces of the heat exchanger absorb the radiant heat emitted by the burner bed and the hot flue gas, said radiant heat being substantially in the infrared range.

In order to permit the production of boiler plants which are optimized under these two aspects, it has been known before—as appears from DE-C-22 45 357—to equip heat exchangers with so-called ribbed pipes as heat exchanger pipes. These ribbed pipes consist of a straight pipe passed by a heat exchanger fluid, for example water, with flat ribs in the form of circular discs extending radially therefrom. The ribs are arranged in spiral form around the pipe and extruded together with the latter. Both the pipe and the ribs consist preferably of a copper/beryllium alloy which offers particularly good thermal conductivity. These known ribbed pipes have a very large heat-transmitting surface and are, therefore, particularly well suited as convective heat exchangers. However, when several of these pipes are arranged in parallel and close to each other to form a heat exchanger above the burner bed, the ribs extend substantially perpendicularly to the surface and the radiation field of the burner bed which means that, except for the pipes, the heat exchanger is almost perfectly transmissive to the infrared radiation of the radiant heat.

Consequently, a large portion of the radiant heat of the burner emitted by the flames of the burner bed is lost. The portion of the radiant heat relative to the total heat developed in the combustion chamber is, however, relatively large, due to the high combustion temperatures, in particular when the combustion chambers are not cooled at all, or are cooled only partially.

In order to overcome this problem, it has been known from the before-mentioned DE-C-22 45 357 to arrange so-called baffles on that side of the ribs protruding from the ribbed pipes forming the heat exchanger, which faces away from the burner bed, so as to collect at least part of the portion of the radiant heat escaping through the ribs.

However, these measures have proved insufficient in certain applications, and this mainly because the baffles, viewed in the direction of flow of the hot flue gases, are arranged behind the substantially convective heat exchangers. The radiant heat collected by the baffles is, therefore, passed on to the flue gases which have already been carried off and is consequently lost unless an additional heat exchanger, in particular a condensing heat exchanger in a condensing boiler, is provided.

An additional disadvantage is seen in the fact that due the radially projecting arrangement of the ribs the baffles can be in contact only with the narrow edges of the ribs so that only poor heat transmission can be achieved between the baffles and the ribs, which in turn supports the before-described release of the collected radiant heat into the cooled flue gases because baffles can give off the heat to the ribs either not at all or only insufficiently, due to the poor heat transmission conditions.

Finally, it has been known from the before-mentioned DE-C-22 45 357 to bend over the sides of the radially projecting ribs so that the bent-over portions extend perpendicularly to the burner bed. This measure serves the purpose to permit neighboring heat exchanger pipes to be arranged more closely to each other in a heat exchanger—an object which is achieved by the fact that—viewed from the front—the outer contour of the heat exchanger pipes resembles the shape of a circle which is flattened on both sides. Although this measure actually reduces the "window" which is formed by the ribs between the heat exchanger pipes and which forms a practically open passage for the radiant heat, it has been found that this measure is also insufficient for achieving particularly high efficiency.

FR-A-667 479 describes another heat exchanger of the type described above where flat ribs project radially from a cylindrical pipe as heat exchanger fins. Viewed in the axial direction, the ribs have a rectangular contour and are bent off at their edges, the latter being simultaneously provided with rectangular punched openings. This feature of the known heat exchanger serves the purpose of permitting the bent-over edges of the one rib to engage the rectangular opening of the neighboring rib when the ribs are pushed together closely so that the interconnected ribs as a whole provide additional mechanical stability. This mechanical stability is necessary because the heat exchanger pipe as such is very thin, and also thin-walled, so that in the absence of the additional interconnection between the ribs they would deflect under the weight of the ribs. As to the mounted position of the known heat exchanger, no information is provided. However, as the gaps between the bent-off edges of the ribs are substantially larger than the width of the ribs and also substantially larger than the diameter of the heat exchanger pipe, the rising hot flue gases would flow past the heat exchanger pipe practically along a straight line so that the efficiency of this heat exchanger is only insignificantly better than that of the heat exchanger pipe according to DE-C-22 45 357 described before.

Now, it is the object of the present invention to improve a gas-fired boiler plant of the type described before in a manner ensuring still better utilization of the radiant heat and, simultaneously, an improvement of the convective heat transmission, so as to permit the implementation of boiler plants providing increased efficiency.

This object is achieved according to the invention by an arrangement in which the bent-over edges are inclined, at least partly, relative to the surface of the burner bed, the ribs being subdivided over their periphery into eight sections of substantially equal size which, except for two diametrically opposite sections, are provided with the bent-over edges, and in which in the mounted condition of the heat exchanger the sections not provided with such bent-over edges are disposed in vertical arrangement, one above the other, relative to the surface of the burner bed and provided with openings permitting the flue gases rising from the burner bed to enter and/or leave the gaps, the openings and the diameter of the pipes being sized in such a manner that the direction of flow of the rising flue gases is changed several times so that the flue gases flow around the pipes along a substantially semi-circular path.

This feature solves the problem underlying the invention fully and perfectly in two ways.

On the one hand, the bent-off portions which are now provided in an inclined position in the flow path of the rising hot flue gases have the effect to increase substantially the surface which is available for absorbing the radiant heat and which is connected rigidly with the heat-exchanger pipes so as to provide optimum heat transmission.

This is true because the surface formed by the bent-off portion and available for absorption of the radiant heat is now located directly above the burner bed and, thus, suited particularly well for absorbing the radiant heat. In the case of the known boiler plants, this was not possible because the before-described separate baffles could not be provided on the bottom of the heat-exchanger pipes. Given the poor heat transmission between the baffles and the ribs of the heat exchanger pipes, which has also been mentioned before, these baffles would have been heated up to an inadmissible degree if arranged in the direct neighborhood of the burner bed. This is now avoided by the before-mentioned feature of the invention, because the surface available for absorbing the radiant heat, which is formed by the bent-off portions, is formed integrally with the ribs of the heat exchanger pipes so that the heat is carried off optimally.

On the other hand, the inclined bent-off portions arranged in the flow path of the rising flue gases have the effect to increase considerably the turbulence of the flue gases and this in turn also improves considerably the convective heat transmission to the ribs of the heat exchanger pipes.

This is due to the fact that this particular arrangement creates a labyrinth-like chamber system in the heat exchanger which, when being passed by the rising hot air, provokes a particularly high degree of turbulence so that the convective heat transmission is still further improved. In addition, the bent-off portions arranged at the "outlet" of the heat exchanger serve to absorb the remaining radiant heat of the flue gases almost completely, and this even so long as the flue gases are still passing the heat exchanger.

These two effects support each other, so that the gas-fired boiler plant according to the invention offers a notably higher efficiency than can be achieved by the prior art. This factor is of particular importance in the case of gas-fired boiler plants with modulated operation, where the burner efficiency is varied continuously in response to the heat consumption given at any time, as compared with so-called on/off burners which either run at full load or are switched off. For, when a boiler plant with modulated operation is run at low load, it is particularly important that the heat generated by the burner bed be carried off as useful heat as completely as possible. This then leads to a notably improved average annual efficiency which compares very well with the high efficiencies of so-called condensing boilers where the flue gases rising from the (first) heat exchanger are cooled by a second condensing heat exchanger connected downstream and where the heat of condensation so gained is also used for heating up the boiler water.

It goes, however, without saying, that the gas-fired boiler plant according to the invention may be equipped either with only one heat exchanger, or also with an additional condensing heat exchanger to form a condensing boiler.

Finally, the two effects described above combine the advantages of the before-described conventional heat exchangers of gas-fired boiler plants with the advantageous effects of the invention. On the one hand, the heat exchanger pipes which are designed as ribbed pipes and which are commercially available as semi-finished products, and the machines for bending-over their edges as well, can be used without any change, while on the other hand it is possible with the aid of the special configuration explained before to achieve the best possible results regarding the utilization of the radiant heat and the convective heat transmission. The approx. octagonal shape of the heat exchanger pipes—viewed from the side—with inlets and outlets for the rising flue gases arranged at the bottom and at the top, respectively, provide on the one hand a surface for absorbing the radiant heat which is located at the bottom of the heat exchanger and which occupies almost two thirds of the surface of the heat exchangers; on the other hand, the octagonal shape has the effect to guide the flue gases in the heat exchanger along an approx. annular path around the pipes which are filled with water, and causes the flow direction to be changed twice which leads to particularly high turbulence and, thus, optimum convective heat transmission. The same applies analogously to the outlet side of the heat exchanger where the rising flue gases, after having passed the pipes filled with the boiler water, leave the heat exchanger in a chimney-like flow, passing by the two bent-over portions in the outlet area. This again optimizes the utilization of the convective heat just as the utilization of the residual radiant heat.

In a preferred embodiment of the invention, the bent-over portions extend at an angle of 45° relative to the surface of the burner bed.

Whilst other angles also lead to satisfactory results, this angle has proved to be particularly advantageous because on the one hand the surface for absorbing the radiant heat is relatively large, while on the other hand optimum turbulence is achieved in the rising flue gases when the bent-off portions are inclined at an angle of 45°.

According to a further embodiment of the invention, the heat exchanger pipes are arranged as heat exchangers in the conventional manner, closely beside and parallel to each other. According to another preferred embodiment of the invention, bent-over portions of neighboring heat exchanger pipes arranged on the side of the heat exchanger facing away from the burner bed are interconnected by axially extending baffles in the manner heretofore known; but in this case the baffles rest on the bent-over portions. In particular, the baffles may be formed as V sections having an inner angle of 90° when the bent-over portions are inclined at an angle of 45°.

This feature provides the particular advantage that the flue gases flowing through the heat exchanger are utilized to a particularly high degree in the outlet area because the heat exchanger surface is almost fully closed, except for narrow axial gaps. The fact that the baffles now rest on the bent-over edges ensures also notably improved transmission of heat between the baffles and the ribs, as compared with the prior art.

Finally, another embodiment according to the invention is preferred where the boiler plant is designed as a condensing boiler and where the flue gases rising from the burner bed pass initially the heat exchanger pipes equipped with the described inclined bent-over portions and are then introduced into another heat exchanger designed as a condensing heat exchanger.

It is also possible, either at the same time or alternatively, to operate the boiler plant in a modulated way.

The two last-mentioned features offer, either individually or in combination, the advantage described before, namely to optimize the efficiency of the whole boiler plant in the best possible way.

Other advantages of the invention will become apparent from the following description and the attached drawing.

It is understood that the features that have been mentioned before and that will be described hereafter can be used not only in the given combinations, but in any other combination or individually as well, without leaving the scope of the present invention.

Certain embodiments of the invention will be described hereafter with reference to the drawing in which FIG. 1 shows a diagrammatic perspective view (partly broken away) of a gas-fired boiler plant according to the invention;

FIGS. 2 and 3 show two views of heat exchangers of the prior art;

Figure 1:
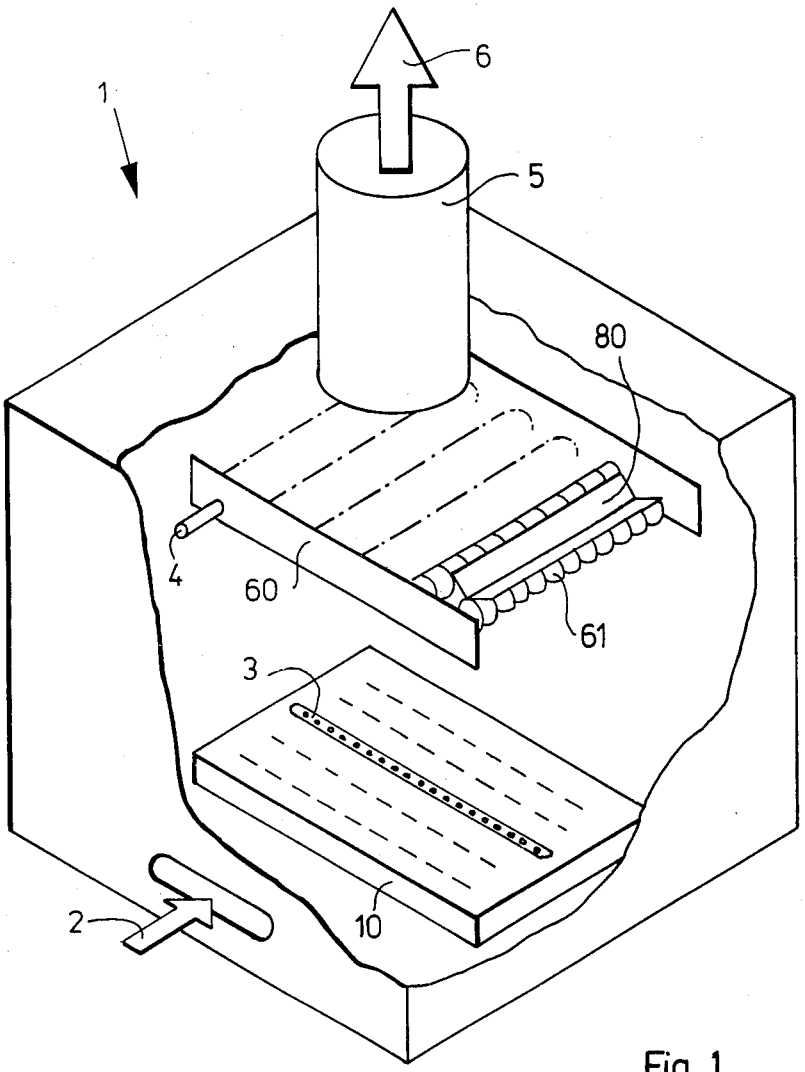

In FIG. 1, reference numeral 1 designates a gas-fired boiler plant of the type used in buildings of the most different types. The boiler plant 1 comprises an air inlet 2 leading to the area of a burner bed 10 assembled from several burner rods 3. A flame bed is produced above the burner bed 10 by a controlled gas supply—not shown in FIG. 1—and a fresh air supply 2 which may also be controlled. Consequently, hot air rises from the flame bed and gets into the area of a heat exchanger 60. The heat exchanger 60 is equipped with boiler water connections 4 for directing the boiler water used for heating purposes through the heat exchanger. Flue gas 6 that has passed the heat exchanger 60 can escape to the outside through a flue 5.

The heat exchanger 60 comprises a plurality of heat exchanger pipes 61 which may be covered partly by baffles 80, as will be described hereafter in detail with reference to FIGS. 4 and 5.

The boiler plant 1 according to FIG. 1 may of course also comprise several heat exchangers arranged on top of each other. In this case, the first heat exchanger normally acts to absorb the radiant heat emitted by the burner bed 10 and to carry off also, by convective heat transmission, a large portion of the heat contained in the flue gases, while a second heat exchanger connected downstream acts as a condensing heat exchanger to cool the flue gas 6 still further by condensing the humidity contained therein, absorbing the latent heat of this humidity. In the case of these boiler plants, which are also described as condensing boilers, the cooling water flows initially through the condensing heat exchanger and then through the heat exchanger 60 illustrated in FIG. 1.

FIG. 2 shows a side view, and FIG. 3 a top view, of a burner bed 10 and a heat exchanger 11 arranged thereabove, according to the prior art.

The heat exchanger 11 consists of several heat exchanger pipes 15, 16 arranged in parallel one beside the other, of which only two are shown fully in FIGS. 2 and 3.

The heat exchanger pipes 15, 16 consist of a central pipe 17, 18 with ribs 19, 19*a*... or 20, 20*a*... in the form of circular disks projecting radially therefrom. The ribs 19 and 20 extend in the form of a spiral around the pipes 17, 18, and are preferably extruded together with the latter. The pipes 17, 18 and the ribs 19, 20 are made from a material offering high thermal conductivity, preferably from a copper/beryllium alloy.

The pipes 17, 18 are passed by the water 21 of a heating plant of a building.

The ribs 19, 19*a*... or 20, 20*a*... are provided with lateral bent-over portions 23 and 24 in such a manner that marginal areas in the form of circular segments are bent off by 90° from the surface of the ribs 19 and/or 20 which itself exhibits the form of a circular disk. The bent-off portions 23, 24 extend perpendicularly to the surface of the burner bed 10. This ensures, as can be seen very clearly in FIG. 2, that the heat exchanger pipes 15, 16 can be arranged closely adjacent each other leaving however a distance of, for example, one millimeter between the bent-off portions 23, 24 of neighboring heat exchanger pipes 15, 16.

On their upper side facing away from the burner bed 10, each pair of heat exchanger pipes 15, 16 is covered by a baffle 30 spanning the gap between neighboring heat exchanger pipes 15, 16. For the sake of clarity, only one such baffle is shown in part in FIG. 3.

Upon ignition of the burner bed 10, flue gases 40 rise up and flow along a substantially straight path, indicated at 41, up to the slot-shaped openings 42 limited laterally by the baffles 30, and then out of the heat exchanger 11 as indicated by arrows 43. On their path, the flue gases 40 pass gaps 44, 44*a*... defined by the ribs 19, 19*a*..., the pipe 17 and the bent-off portions 23.

Although—viewed from the burner bed 10—the baffles 30 cover the "window" 48 between the pipes 17, 18 so that the baffles 30 absorb at least part of the radiant heat emitted by the rising flue gases 40, it can be clearly seen in FIG. 2 that the contact surface 49 between the baffles 30 and the ribs 19, 19*a*... or 20, 20*a*... provides poor heat transmission because the ribs 19, 19*a*... or 20, 20*a*... are in contact with the baffles 30 only by their narrow sides.

Figure 4:
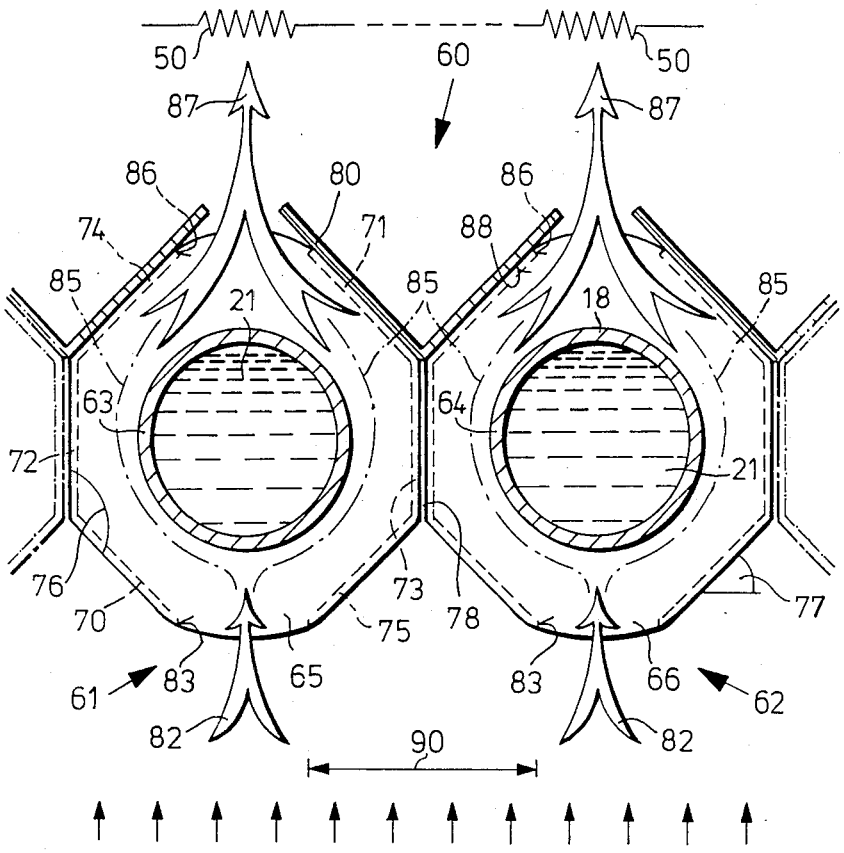
FIGS. 4 and 5 show two views, similar to FIGS. 2 and 3, but for an embodiment of the invention.
Figure 5:
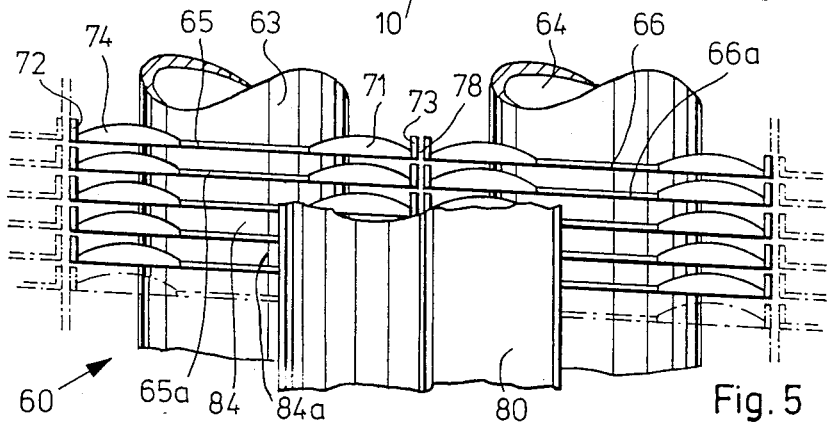

In contrast, FIGS. 4 and 5 show a heat exchanger 60 as mentioned already in FIG. 1 and as used for the purposes of the present invention. The heat exchanger 60 consists again of heat exchanger pipes 61, 62 arranged in parallel to each other and consisting of pipes 63, 64 with ribs 65, 65*a*... and/or 66, 66*a*... projecting radially therefrom.

The semifinished material used for the heat exchanger pipes is identical for the embodiment according to FIGS. 4 and 5 and for the prior-art embodiment shown in FIGS. 2 and 3; yet the heat exchanger pipes are designed differently for use in the boiler plant according to the invention.

As can be seen clearly in FIG. 4, the ribs 65, 66 are subdivided about their periphery into eight circumferential sections of substantially equal length. Except for two diametrically opposite sections, all the other six sections are provided with bent-off edge portions 70, 71, 72, 73, 74, 75. Due to this roughly octagonal configuration, each pair of neighboring bent-off portions, for example 70, 72, includes between them an angle 76 of 135°. In the assembled condition of the heat exchanger 60, the areas which are not bent off are arranged above each other and vertically above the burner bed 10 so that in this assembled condition four of the totally six bent-off portions, i.e. the portions 70, 71, 74 and 75 extend at an angle 77 of 45° relative to the surface of the burner bed 10.

In the case of this configuration, baffles 80 provided on the upside of the heat exchanger 60 and resting on two neighboring heat exchanger pipes 61, 62 each are designed as V-shaped sections with an inner angle of 90°.

In this manner, one obtains a chamber system within the heat exchanger tubes 60, 61 because the bent-off portions 70, 72, 74 and/or 71, 73, 75 form lateral covers leaving only a passage from the bottom to the top. The flue gases 82 rising from the bottom enter this chamber system initially through an opening 83 formed by the lower edges of the bent-off portions 70 and 75, and get into the interspaces **84, 84*a* . . . formed by the ribs 65, 65*a* . . . , the pipe 63 and the bent-off portions 70 to 75. The flue gases 82 then flow from these almost closed interspaces 84, 84*a* . . . through an opening 86 defined by the upper edges of the bent-off portions 71 and 74, out of the heat exchanger 60 in the direction indicated by arrow 87. On their way out of the heat exchanger 60, the flue gases follow a path indicated at 85 which extends roughly circularly around the pipes 63, 64 and changes its direction three times, due to the straight inflow and outflow at 82 and 87**.

Sealing at the top is particularly efficient in this case because the baffles 80 act to close the openings 86 still further leaving an even narrower slot. The heat transmission between the baffles 80 and the ribs 65, 66 is particularly good because the baffles 80 do not rest on the narrow sides of the ribs 65, 66 but rather on the full surfaces of the bent-off portions 71 and 74.

Viewed under the aspect of convective heat transmission, the heat exchanger according to FIGS. 4 and 5 is clearly superior to that shown in FIGS. 2 and 3 because, as mentioned before, the flue gases 82 are guided in almost close interspaces **84, 84*a* . . . in a turbulent manner along a path changing its direction several times so that the flue gases 82 are caused to give off their heat almost completely to the surrounding surfaces and/or the bent-off portions 70 to 75 of the ribs 65, 66**.

The utilization of the radiant heat is clearly improved as well because portions of the burner bed 10 of a width 90 are faced by absorbing surfaces constituted by the bent-off portions 70 and 75 which occupy almost two thirds of the total surface of the heat exchanger 60 facing the burner bed 10.

It goes without saying that the embodiment illustrated in FIGS. 4 and 5 is to be understood as an example only and that of course numerous modifications, in particular of the configuration of the ribs and the bent-off portions, are possible without leaving the scope of the present invention.

In particular, instead of using ribs exhibiting the shape of circular disks, it is, for example, also possible to give the ribs a rectangular or square shape; instead of the octagonal shape of the bent-off portions another polygonal shape may be used, or the inlet and/or outlet openings for the flue gases may be provided in off-center or offset arrangement, without leaving the scope of the invention.

We claim:

1. Gas-fired boiler comprising a burner bed extending over a flat surface and heat exchanger pipes arranged above the burner bed, parallel to the said surface, the heat exchanger tubes comprising pipes equipped with a plurality of flat ribs which extend substantially radially from the said pipes, which are provided in spaced arrangement over the length of the said heat exchanger pipes, which exhibit roughly the shape of annular rings and which are provided with bent-off portions formed by folding over marginal areas exhibiting roughly the shape of circle segments, and the flue gases rising from the burner bed flowing through the gaps formed between the said ribs and pipes, wherein said bent-over edges are inclined, at least partly, relative to the surface of said burner bed, said ribs being subdivided over their periphery into eight sections of substantially equal size which, except for two diametrically opposite sections, are provided with said bent-over edges, and wherein in the mounted condition of said heat exchanger the sections not provided with such bent-over edges are disposed in vertical arrangement, one above the other, relative to the surface of said burner bed and provided with openings permitting the hot flue gas rising from said burner bed to enter and/or leave the gaps, the openings and the diameter of said pipes being sized in such a manner that the direction of flow of the rising flue gases is changed several times so that the flue gases flow around said pipes along a substantially semi-circular path.

2. Boiler plant according to claim 1, wherein said bent-over portions extend at an angle of 45° relative to the surface of said burner bed.

3. Boiler plant according to claim 1, wherein said heat exchanger pipes are arranged as heat exchangers closely beside and parallel to each other.

4. Boiler plant according to claim 1, wherein bent-over portions of neighboring heat exchanger pipes arranged on the side of said heat exchanger facing away from said burner bed are interconnected by axially extending baffles resting on said bent-over portions.

5. Boiler plant according to claim 4, wherein said baffles are formed as V sections having an inner angle of 90°.

6. Boiler plant according to claim 1, wherein the boiler plant is designed as a condensing boiler where the flue gases rising from said burner bed pass initially said heat exchanger pipes equipped with said inclined bent-over portions and are then introduced into another heat exchanger designed as a condensing heat exchanger.

* * * * *